US008291576B2

(12) United States Patent
Ibe et al.

(10) Patent No.: US 8,291,576 B2
(45) Date of Patent: Oct. 23, 2012

(54) METHOD OF MANUFACTURING LIQUID EJECTION HEAD

(75) Inventors: Satoshi Ibe, Yokohama (JP); Hirokazu Komuro, Yokohama (JP); Takuya Hatsui, Tokyo (JP); Sadayoshi Sakuma, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 511 days.

(21) Appl. No.: 12/484,427

(22) Filed: Jun. 15, 2009

(65) Prior Publication Data

US 2009/0315953 A1 Dec. 24, 2009

(30) Foreign Application Priority Data

Jun. 18, 2008 (JP) ..... 2008-159657

(51) Int. Cl.
*H05B 3/03* (2006.01)
*B05D 1/32* (2006.01)

(52) U.S. Cl. ..... 29/611; 29/890.1; 29/842; 29/846; 347/61; 347/65; 427/98.4; 427/272; 427/282

(58) Field of Classification Search ..... 29/611, 29/890.1, 25.35, 842, 846; 338/307, 314; 347/61, 62, 65, 26, 47; 427/98.4, 272, 282
See application file for complete search history.

(56) References Cited

U.S. PATENT DOCUMENTS

| | | | | |
|---|---|---|---|---|
| 5,322,811 | A | 6/1994 | Komuro et al. | |
| 5,478,606 | A | 12/1995 | Ohkuma et al. | |
| 6,016,601 | A * | 1/2000 | Takemoto et al. | 29/890.1 |
| 6,042,221 | A | 3/2000 | Komuro | |
| 6,114,674 | A * | 9/2000 | Baugh et al. | 338/314 X |
| 6,390,606 | B1 | 5/2002 | Terui et al. | |
| 6,634,736 | B2 | 10/2003 | Miyakoshi et al. | |
| 7,255,426 | B2 | 8/2007 | Ibe et al. | |
| 7,472,975 | B2 | 1/2009 | Hatsui et al. | |
| 7,549,734 | B2 | 6/2009 | Imanaka et al. | |
| 7,588,317 | B2 | 9/2009 | Imanaka et al. | |
| 7,591,071 | B2 | 9/2009 | Ibe et al. | |
| 2002/0080212 | A1 * | 6/2002 | Moon et al. | 29/611 X |
| 2006/0033780 | A1 | 2/2006 | Ono et al. | |
| 2007/0058001 | A1 * | 3/2007 | Hayakawa | 347/65 |
| 2009/0315955 | A1 | 12/2009 | Sakuma et al. | |
| 2009/0315958 | A1 | 12/2009 | Hatsui et al. | |

FOREIGN PATENT DOCUMENTS

| | | | | |
|---|---|---|---|---|
| JP | 05269996 | A * | 10/1993 | 29/890.1 X |
| JP | 6-286149 | | 10/1994 | |
| JP | 11-348290 | | 12/1999 | |
| JP | 2005-199701 | | 7/2005 | |

* cited by examiner

*Primary Examiner* — A. Dexter Tugbang
(74) *Attorney, Agent, or Firm* — Fitzpatrick, Cella, Harper & Scinto

(57) ABSTRACT

Provided is a method of manufacturing a liquid ejection head having an element which generates energy utilized for ejecting liquid and an electrode layer electrically connecting the element. The method includes the steps of: providing an electrode layer on a substrate, a width of one portion of the electrode layer being smaller than that of another portion near the one portion; providing a resist layer on a part of the electrode layer by a screen printing method or a dispense method in such a manner that an end of the resist layer is positioned at the one portion; providing another layer on another part excluding the part of the electrode layer by utilizing the resist layer as a mask; and removing the resist layer.

10 Claims, 8 Drawing Sheets

METHOD OF MANUFACTURING LIQUID EJECTION HEAD

BACKGROUND OF THE INVENTION

1. Field of the Invention

The present invention relates to a liquid ejection head that employs a scheme in which liquid is ejected by using energy, and a method of manufacturing the liquid ejection head.

2. Description of the Related Art

Through similar processes to that for semiconductor manufacturing, a substrate for a liquid ejection head is manufactured by forming, on the same substrate, multiple heaters for heating liquid to generate bubbles when being energized, lines for providing electrical connection to the heaters, and the like. Then, a liquid ejection head is constructed in a way that a member (nozzle formation member) forming ejection openings and liquid passages is provided on the substrate. Here, the ejection openings are provided corresponding to the heaters and are used to eject ink therefrom. Meanwhile, the liquid passages are formed to communicate with the corresponding ejection openings, respectively.

One method of manufacturing the liquid ejection head (see Japanese Patent Laid-Open No. H06-286149 (1994) includes the following steps:

(1) forming a pattern to form the liquid passages on the substrate with a dissolvable resin;
(2) applying a coating resin containing an epoxy resin being solid at ordinary temperature;
(3) forming openings to be the ejection openings in the coated resin; and
(4) dissolving the dissolvable resin layer.

Further, there has been proposed a liquid ejection head and a method of manufacturing a liquid ejection head in which a layer made of a polyetheramide resin (called an adhesion improvement layer below) is interposed between the substrate and the nozzle formation member in order to improve the adhesion between them (see Japanese Patent Laid-Open No. H11-348290 (1999)).

FIG. 8A is a schematic perspective view showing a general example of the configuration of the liquid ejection head, and FIG. 8B is a cross-sectional view taken along the VIIIB-VIIIB line in FIG. 8A. A substrate 1110 made of Si or the like is provided with an ink supply opening 1202 being a slot-like through-hole, and ink is introduced into this ink supply opening 1202. Further, two arrays of heaters 1214 are formed, one on each side of the ink supply port 1202. Electrode portions 202 are formed along a side of the substrate 1110 in a direction perpendicular to an arrangement direction of the heaters 1214. The electrode portions 202 are formed to provide external electric connection to the heaters 1214 or to a logic circuit for selectively energizing the heaters 1214, and are connected to the heaters 1214 or to the logic circuit via lines 201. Then, a nozzle formation member 203 is disposed on the substrate 1110 in a contacting manner. The nozzle formation member 203 is provided with liquid passages 1106 and ejection openings 1107 from each of which ink is ejected toward a printing medium with the action of thermal energy.

To reduce a line resistance value, the following technique has been proposed. Specifically, the lines 201 and the electrode portions 202 are simultaneously formed as a gold (Au) layer by plating (see Japanese Patent Laid-Open No. 2005-199701). Gold has excellent properties as a line material because of its low electric resistance, high chemical stability, high electromigration characteristics, and the like. Particularly, gold is excellent as a line material of a substrate for a liquid ejection head because the lines constantly exist very close to the ink being liquid and are used to energize the heaters to raise their temperature instantly.

Regarding the above lines, there is a need to form an upper layer on the lines in cases as follows.

In the configuration of the liquid ejection head described in Japanese Patent Laid-Open No. H06-286149 (1994) or No. H11-348290 (1999), a surface of metal such as the lines existing on the substrate adheres to an organic resin constituting the nozzle formation member or the adhesion improvement layer. This adhesion is thought to be brought by a physical anchor effect of the organic resin entering the dips in the surface of the metal, and also by chemical bond, hydrogen bond, or the like through the OH groups existing on the surface of the metal.

However, depending on the line material, the following problems may arise. For example, in a case where lines are formed of gold, as gold is a stable noble metal and has a few OH groups on its surface, gold has poor bonding power with an organic resin. In addition, on a liquid ejection head substrate, the organic resin film swells because ink constantly exists near the ejection openings. Particularly, in a liquid ejection head substrate with heaters, heat generated by the heaters causes the organic resin and the substrate to expand to different degrees. As a result, the liquid ejection head substrate with heaters undergoes internal stress caused by the difference in thermal expansion between the substrate and the organic resin, in addition to the swelling of the organic resin film. This stress could possibly cause separation of the nozzle formation member from the Au layer, originating from and around parts having poor adhesion with the organic resin. To avoid such a separation, an upper layer may be required on the lines. Besides this, an upper layer may be formed for other various objectives. For example, an upper layer may be required on a desired portion of lines in order to improve the reliability by protecting a line surface and the like from damages.

A possible way to form the upper layer is to form and then pattern a film of an insulating material, such as SiN or SiC by using a vacuum film forming device or the like, on and in the vicinity of the lines. However, since the vacuum film forming device and a patterning device are expensive, the above way will result in increased costs for manufacturing the substrate, and in turn, the liquid ejection head. In addition, there is concern that the manufacturing process of the substrate becomes complex. Moreover, the above way may possibly lower the energy efficiency in a liquid ejection head that employs the scheme in which liquid is ejected by using energy generated by the heaters.

SUMMARY OF THE INVENTION

The present invention has been made in consideration of the above problems. An objective of the present invention is to provide a method for obtaining a liquid ejection head with high reliability by providing a proper laminating state of layers disposed as upper layers on lines on the substrate in a simple way.

In an aspect of the present invention, there is provided a method of manufacturing a liquid ejection head having an element which generates energy utilized for ejecting liquid and an electrode layer electrically connected the element, the method comprising the steps of:

providing an electrode layer on a substrate, a width of one portion of the electrode layer being smaller than that of another portion near the one portion;

providing a resist layer on a part of the electrode layer by a screen printing method or a dispense method in such a manner that an end of the resist layer is positioned at the one portion;

providing another layer on another part excluding the part of the electrode layer by utilizing the resist layer as a mask; and removing the resist layer.

In another aspect of the present invention, there is provided a liquid ejection head comprising:

a substrate provided with an element which generates energy utilized for ejecting liquid;

an electrode layer provided on the substrate and electrically connected the element; and a metal-containing layer provided on a part of the electrode layer, wherein a portion of the electrode layer on which an end of the metal-containing layer is provided has a smaller width than another portion near the portion.

According to the present invention, upper layers are allowed to be properly laminated on lines in a simple manner. As a result, the reliability of the liquid ejection head can be improved without complicating the manufacturing process.

Further features of the present invention will become apparent from the following description of exemplary embodiments (with reference to the attached drawings).

DESCRIPTION OF THE EMBODIMENTS

The present invention will be described in detail below with reference to the drawings.

Figure 1:
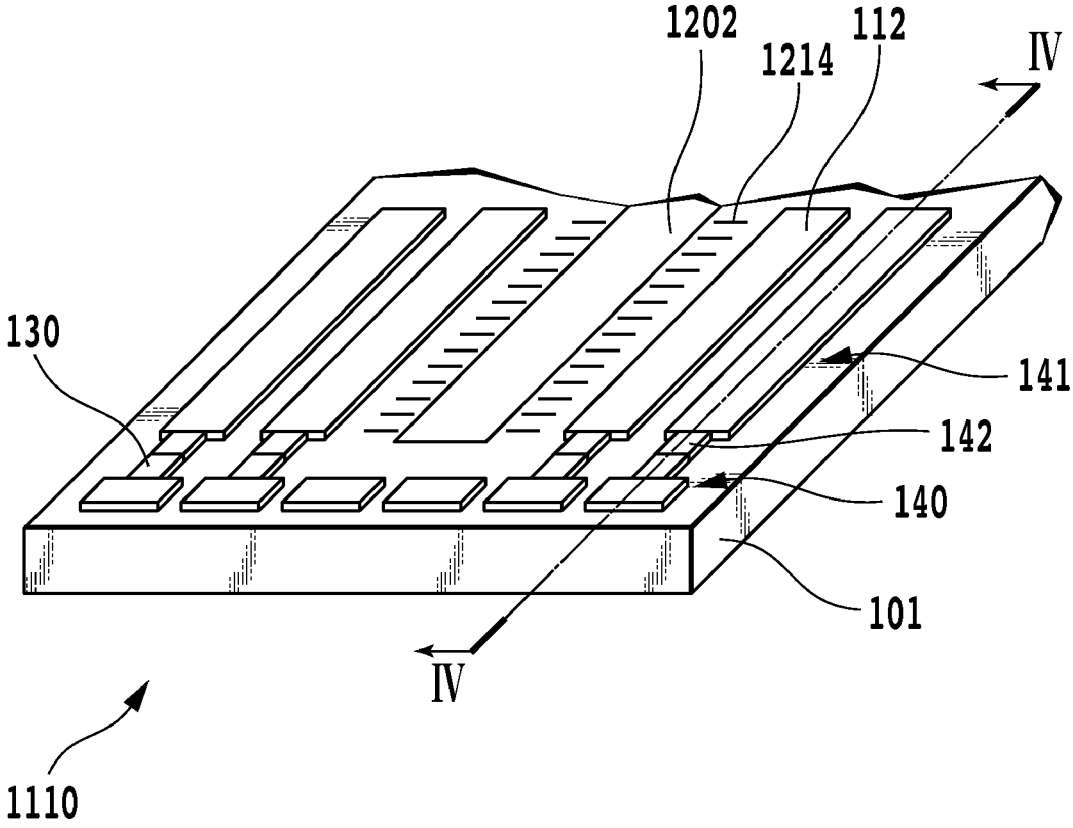
FIG. 1 is a schematic perspective view showing a configuration example of a substrate for a liquid ejection head according to an embodiment of the present invention.
Figure 8A:
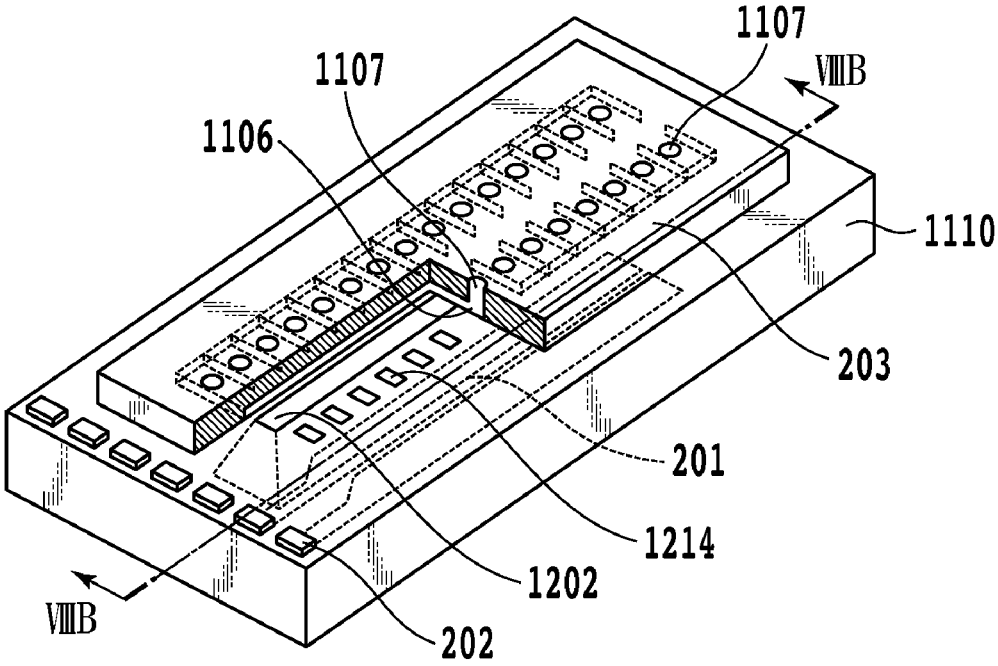
FIG. 8A is a schematic perspective view showing a general example of the configuration of the liquid ejection head.
Figure 8B:
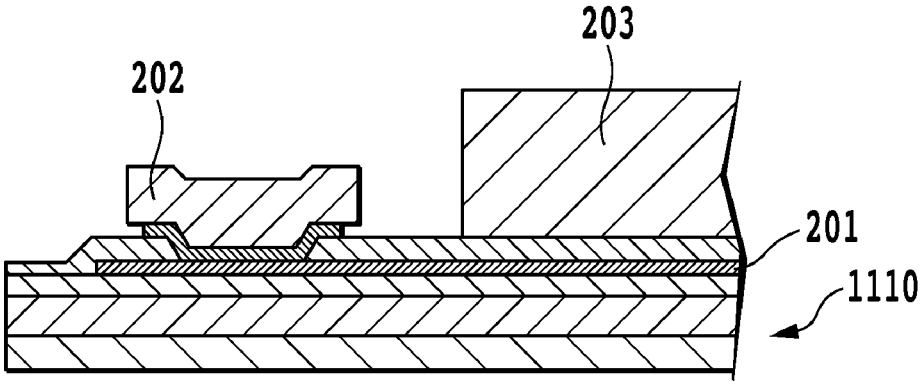
FIG. 8B is a cross-sectional view taken along the VIIIB-VIIIB line in FIG. 8A.

FIG. 1 is a schematic perspective view showing a configuration example of a substrate for a liquid ejection head according to an embodiment of the present invention. Parts configured similarly to those in FIGS. 8A and 8B are denoted by the same corresponding reference numerals.

In a substrate 1110 of the present embodiment, electrode portions 140 and line portions 141 are formed on the base plate 101 made of Si or the like, and are connected at the surface of the base plate 101. These portions can be simultaneously formed by forming a layer (Au layer) 130 containing gold as a main component, by plating. In the present embodiment, Au is used as a plating material. Instead, any other low-resistant metallic material containing Cu, Ag, or Pd as a main component can also be used. The electrode portions 140 are connected with a flexible printed circuit board using, for example, a tape member for tape-automated bonding (TAB), and are thereby allowed to transmit and receive electrical signals to and from a main body of a liquid-ejection type of printing apparatus device (not shown). Formed on and in the vicinity of surfaces of the line portions 141 is a layer 112 for providing adhesion with an adhesion improvement layer made of an organic resin such as a polyetheramide resin, or the nozzle formation member made of a resin, or the like.

The layer 112 is formed so that its end surface is positioned at a connecting portion 142 between each of the electrode portions 140 and of the line portions 141. The connecting portion 142 is formed so that its width in a direction traversing a longitudinal direction is smaller than those of the electrode portion 140 and the line portion 141. This is for blocking a mask material 113 from flowing into the line portion 141 when the mask material 113 is applied to the electrode portion 140 before removal of a photoresist 122. The viscosity of the mask material 113 may be selected depending on the width of the connecting portion 142. Such formation of the layer 112 has two meanings. Firstly, the layer 112 plays a role of improving the adhesion between the gold lines and an organic resinous member (nozzle formation member) formed above it. Certain improvement of the adhesion with the organic resinous member can be observed visually if an end part of the layer 112 is sticking out of the organic resinous member. Secondly, by being formed to have a small width, the connecting portion 142 can serve as a characteristic mark (characteristic part) for recognizing the area to which a flexible printed circuit member for supplying power to the liquid ejection head is to be connected.

Figure 2A:
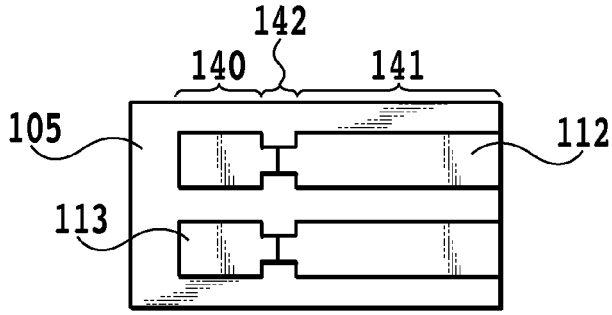
FIGS. 2A to 2E are schematic plan views showing various configuration examples of a connecting portion of an electrode portion and a line portion on a substrate shown in FIG. 1.
Figure 2B:
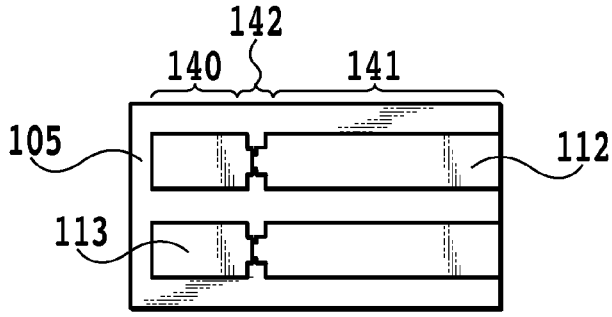
Figure 2C:
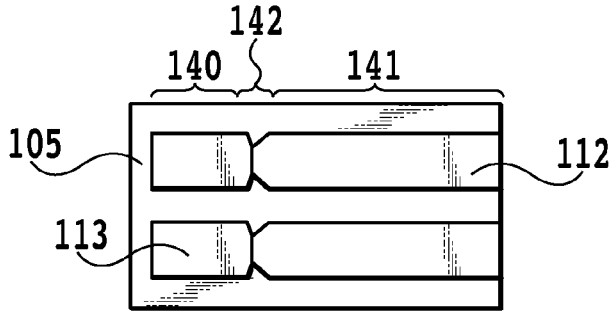
Figure 2D:
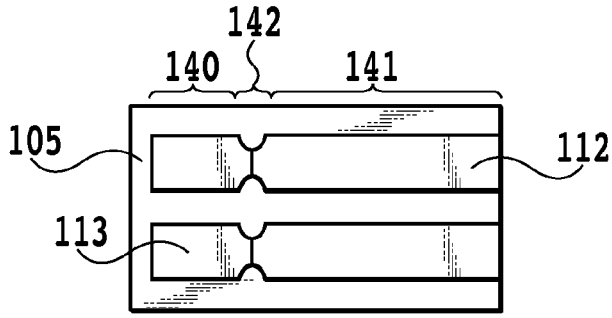
Figure 2E:
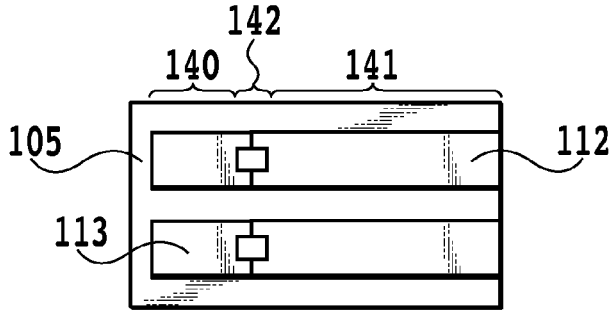

FIGS. 2A to 2D show various shape types of the connecting portion 142. As shown in these drawings, the shape of the connecting portion 142 can be determined appropriately as long as it can serve as a visual observation mark used in: recognizing the position of the end part of the layer 112; connecting the electric circuit board; and forming ejection openings. Further, as shown in FIG. 2E, as long as the connecting portion 142 can serve as the visual observation mark, it may have substantially the same width as the electrode portion 140 and the line portion 141 and then have a part that can be a characteristic mark (an opening in FIG. 2E).

For example, the line portion 141 can serve as a common power supply line or a common ground line that are connected to the multiple heaters 1214 to supply power to them. Via through holes, the line portion 141 may be connected to lines which are formed of Al or the like and are connected to the corresponding heaters 1214 individually.

Figure 3:
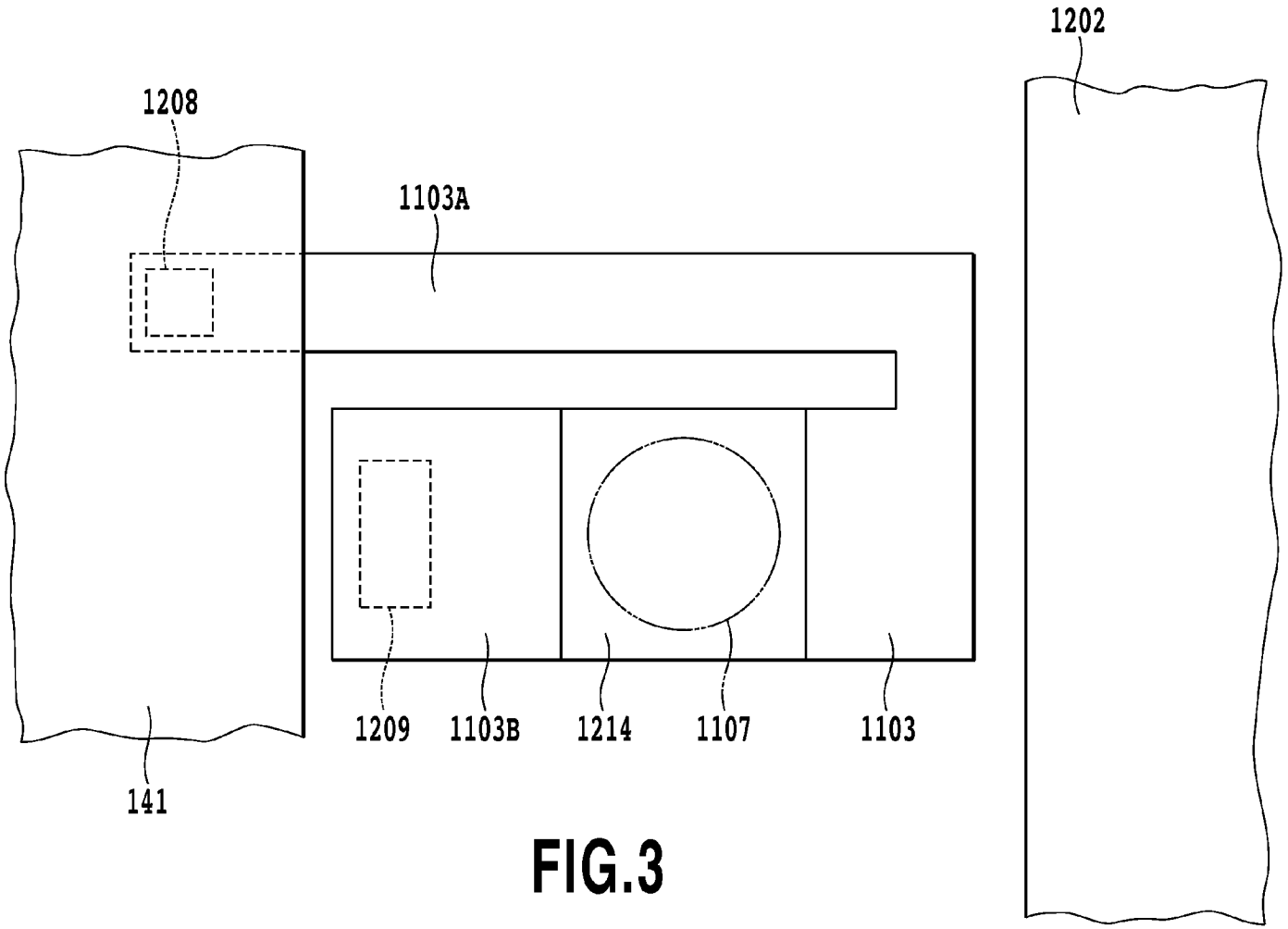
FIG. 3 is a schematic plan view illustrating a connection state between common lines and individual heater lines on the substrate of FIG. 1.

FIG. 3 is a schematic plan view showing an example of the configuration of and around the heaters 1214 on the substrate 1110. The multiple heaters 1214 are formed on the base plate 101 onto which a drive circuit including driving elements is built in advance. The driving element is formed of a semiconductor element such as a switching transistor, and selectively drives the heater 1214. The heaters 1214 are formed as follows. First, a heating resistor layer is formed on the base plate 101. Further, an electrode layer is laminated, from which lines (heater lines) 1103 for the heaters 1214 are formed. Then, a desired pattern is formed by continuously etching the layers. Moreover, the electrode layer is removed in part to expose the heating resistor layer underneath.

For example, one end of each of the heaters 1214 can be connected to the line portion 141 serving as the common power supply line, via one part 1103A of the heater line 1103 and then a through-hole part 1208. The other end of the heater 1214 is connected to the drive circuit formed in the layer underneath, via another part 1103B of the heater line 1103 and then, for example, a through-hole part 1209. The other end of the heater 1214 can be then connected to a line portion serving as the common ground line.

Figure 4:
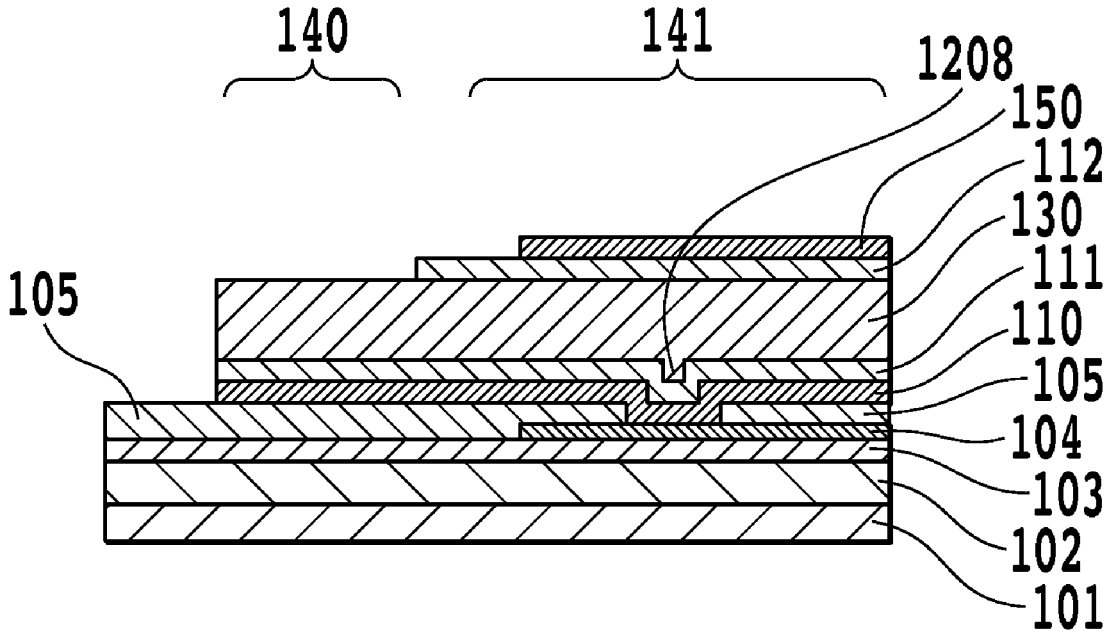
FIG. 4 is a schematic cross-sectional view taken along the IV-IV line in FIG. 1, and shows the layer structure of the electrode portion and the line portion.

FIG. 4 is a schematic cross-sectional view taken along the IV-IV line in FIG. 1.

In FIG. 4, reference numeral 102 represents a heat accumulating layer made of $SiO_2$ formed on a silicon (Si) base plate 101. Reference numeral 103 represents a heating resistor layer from which the heaters 1214 are formed. Reference numeral 104 represents an Al line layer from which the heater lines 1103 connected with the heaters 1214 individually are formed. Reference numeral 105 represents a protection layer covering these layers, and reference numeral 110 represents a diffusion prevention layer.

Reference numeral 111 is a layer (called a plating underlayer) used as an electrode which is used when the electrode portion 140 and the line portion 141 are simultaneously formed with the Au layer 130 by electrolytic plating. The plating underlayer 111 may be an Au layer formed on the diffusion prevention layer 110. The plating underlayer 111 is also used when the metallic layer 112 is formed on the Au layer 130 by plating to provide adhesion with the organic resinous member. A material used for the layer 112 is an inorganic material having more OH groups than gold, in other words, a material providing higher adhesion with an organic resin than gold. In the present embodiment, nickel (Ni) is used. In this case, the layer 112 may be a layer which substantially contains Ni only, or may be made of an alloy containing Ni. In addition, reference numeral 150 is an adhesion improvement layer formed on the metallic layer 112 to improve adhesion with the nozzle formation member 203. The adhesion improvement layer 150 can be formed by patterning of a polyetheramide resin.

Using FIGS. 5A to 5H, a description will be given of a method of manufacturing the substrate shown in FIG. 4.

Figure 5A:
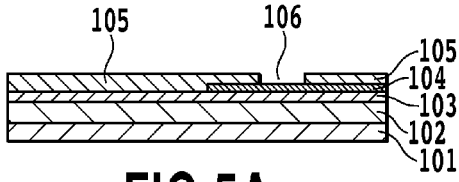
FIGS. 5A to 5H are diagrams illustrating the steps for obtaining the structure shown in FIG. 4.

Firstly, as shown in FIG. 5A, the heat accumulation layer 102 is formed in an about 1 μm thickness on the Si base plate 101 by thermal oxidation. Further, the heating resistor layer 103, the Al line layer 104, and the protection layer 105 are formed by a vacuum film forming method or the like. Then, a through-hole 106 is formed by photolithography patterning to provide electrical conduction between the metallic layer (Au layer) 130 to be the line portion 141 and the Al line layer 104 to be the individual heater lines 1103. Note that, a drive circuit including semiconductor elements, such as switching transistors for selectively driving the heaters 1214, can be built in the base plate 101 in advance.

Figure 5B:
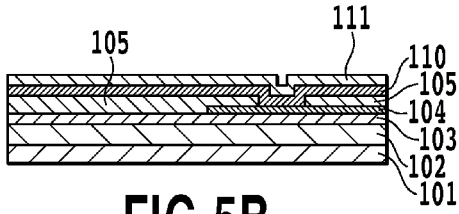

Next, as shown in FIG. 5B, the diffusion prevention layer 110 and the plating underlayer 111 are formed on the entire surface by using a vacuum film forming device or the like. Specifically, the diffusion prevention layer 110, which is made for example of titanium tungsten being a high-melting-point metal material, is formed in an about 200 nm thickness, and the gold plating underlayer 111 is formed in an about 50 nm thickness.

Figure 5C:
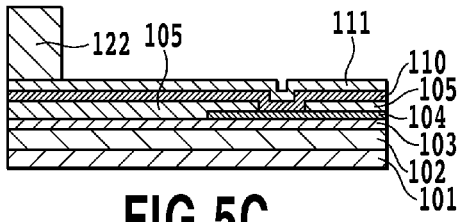
Figure 6A:
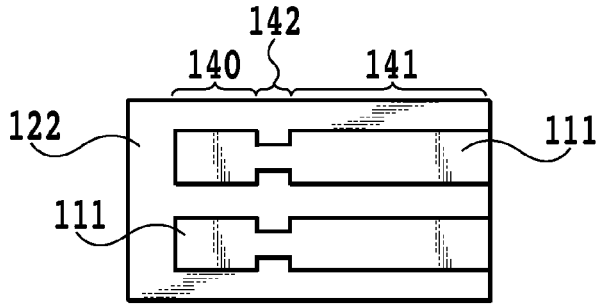
FIGS. 6A, 6B, 6C, 6D, and 6E are plan views of FIGS. 5C, 5D, 5E, 5F, and FIG. 4, respectively.

Next, as shown in FIG. 5C, the photoresist 122 is applied, exposed, and developed using photolithographic method. Thereby, an opening is defined in an area for forming the metallic layer 130. Here, the photoresist 122 is applied to have a thickness larger the thickness (height) of the metallic layer 130 to be formed on the substrate. In the present embodiment, the photoresist 122 is formed to have a thickness of 6 μm, whereas the film thickness of the gold plating is about 5 μm. FIG. 6A is a plan view of FIG. 5C. As shown in FIG. 6A, the photoresist 122 is provided in such a manner as to surround the part in which the metallic layer 130 is to be formed. The connecting portion 142 is formed so that its width in the direction traversing the longitudinal direction is smaller than those of the electrode portion 140 and the line portion 141.

Figure 5D:
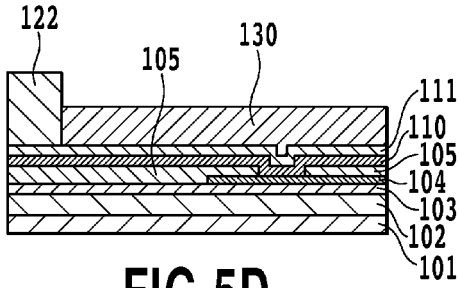
Figure 6B:
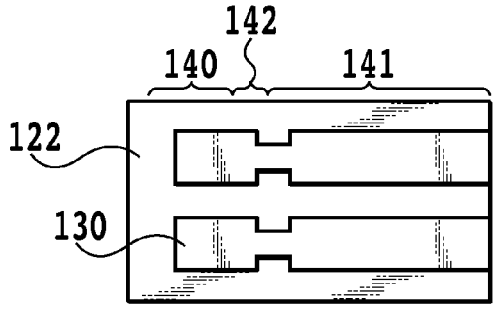

After that, as shown in FIG. 5D, the metallic layer 130 is formed by electrolytic plating. This is carried out for example by immersing the substrate in an electrolytic solution containing gold sulfite, applying a predetermined current to the plating underlayer 111, and depositing gold on a predetermined portion. FIG. 6B is a plan view of FIG. 5D.

Figure 5E:
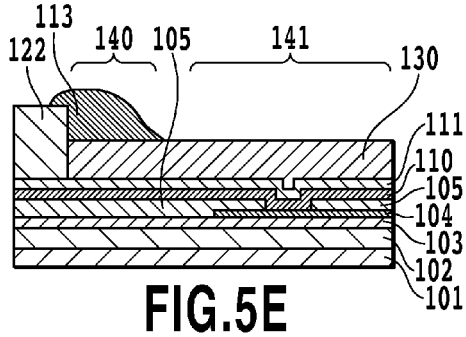

Next, as shown in FIG. 5E, to and in the vicinity of a portion on the layer 130 to be the electrode portion 140, the mask material 113 having the same material as the photoresist 122 is printed by using a screen printing method or is applied by using a dispense method in which a material is ejected from a nozzle. Then, the mask material 113 is hardened at a predetermined temperature. When the screen printing method is used, the mask material 113 can be printed at high speed. Specifically, in the screen printing method, the mask material 113 having the same material as the photoresist 122 is printed by: preparing a printing plate in which a part corresponding to the electrode portion 140 is opened in advance; adjusting the position of the printing plate relative to the substrate; and sliding a squeegee positioned above them onto the printing plate. In the dispense method, on the other hand, the mask material 113 contained in a syringe is applied to a target part in a predetermined amount while forming lines. Accordingly, a production time is less than that in the case of using the screen printing method. However, the dispense method has the following advantages: the solvent of the material does not volatilize in the atmosphere; the viscosity or the like of the material does not change; and there is small variation in the line widths.

Figure 6C:
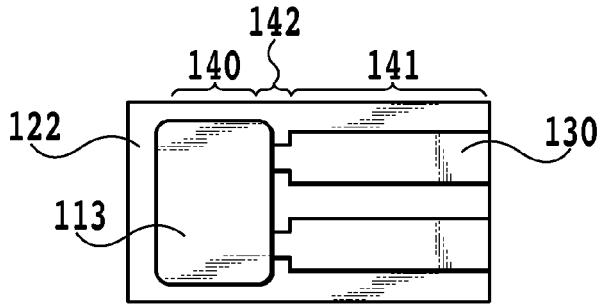

The mask material 113 is applied to the inside of the portion defined by the photoresist 122, along a step formed by the metallic layer 130 and the photoresist 122, the step having about 1 μm height. FIG. 6C is a plan view of FIG. 5E. The mask material 113 can be applied so that its end is positioned at the connecting portion 142, through adjustment of the viscosity and ejection amount of the mask material 113. Here, the connecting portion 142 is a portion where the photoresist 122 is narrowed. Accordingly, if the wettability of the photoresist 122 is properly designed, the mask material 113 can be prevented from spreading toward the inside of the portion defined by the photoresist 122, by positioning the end of the mask material 113 at the narrowed portion of the photoresist 122. As a result, the mask material 113 can be applied to a desired location.

Figure 5F:
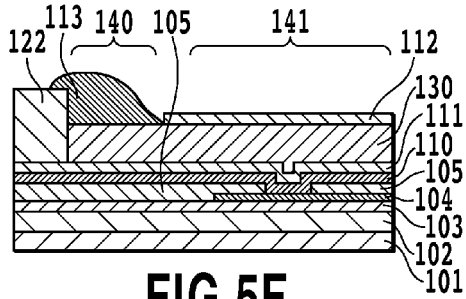
Figure 6D:
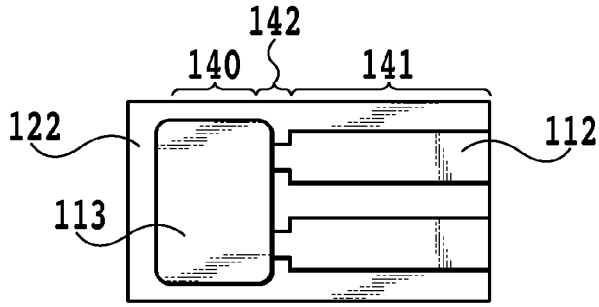

Next, as shown in FIG. 5F, the layer 112 is formed by electrolytic plating. This is carried out for example by immersing the substrate in an electrolytic solution containing nickel sulfamate, applying a predetermined current to the plating underlayer 111, and depositing nickel of an about 200 nm thickness on a predetermined portion, that is, a portion on the Au layer 130 which is to be in contact with the adhesion improvement layer 150. FIG. 6D is a plan view of FIG. 5F.

Figure 5G:
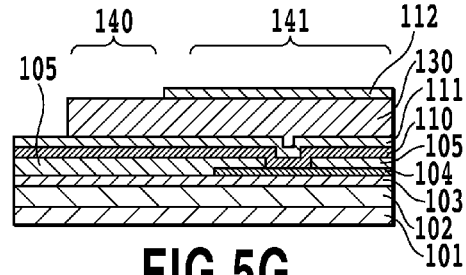

Next, the photoresist 122 and the mask material 113 are removed by immersing the substrate in a predetermined stripping solution for a predetermined length of time. Thereby, as shown in FIG. 5G, the metallic layer (Au layer) 130 is exposed at a portion corresponding to the electrode portion 140, and the plating underlayer 111 is exposed at an end of the substrate.

Figure 5H:
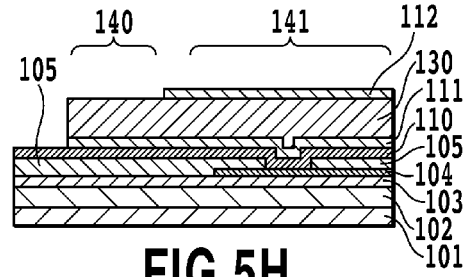

Next, an unneeded part of the plating underlayer 111 exposed at the end of the substrate is removed by immersion in a solution containing nitrogen organic compounds, iodide, and potassium iodide, for a predetermined length of time. Thereby, as shown in FIG. 5H, the diffusion prevention layer 110 is exposed.

Further, an unneeded part of the diffusion prevention layer 110 is removed by immersion in hydrogen peroxide solution for a predetermined length of time. Thereafter, the adhesion improvement layer 150 is formed. The adhesion improvement layer 150 improves the adhesion with the nozzle formation member 203, and also gives the line area insulating properties The adhesion improvement layer 150 can be formed by photolithography patterning of a polyetheramide resin.

Figure 6E:
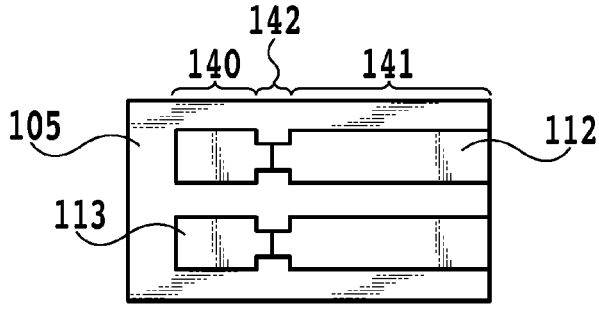

The substrate shown in FIG. 4 can be obtained by the steps described above. FIG. 6E is a plan view of FIG. 4.

Figure 7:
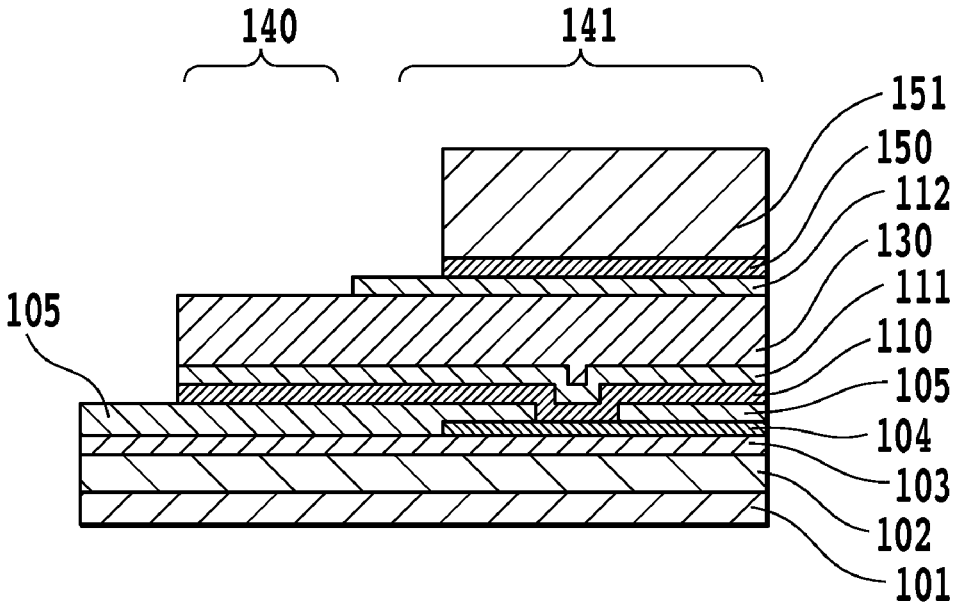
FIG. 7 is a schematic cross-sectional view showing a state in which an organic resin layer to be a nozzle formation member is formed on the substrate of FIG. 4.

Then, as shown in FIG. 7, an organic resin layer 151 to be the nozzle formation member is applied to the adhesion improvement layer 150 to a predetermined thickness by a spin coat method. The organic resin layer 151 is then subjected to exposure, development, and the like by photolithography, and the nozzle formation member 203 is thus formed. For example, the nozzle formation member 203 can be formed using a technique as shown in Japanese Patent Laid-Open No. H06-286149 (1994). To be more specific, the nozzle formation member 203 can be disposed by performing the steps of:

(1) forming a liquid-passage pattern on the substrate manufactured by the above-described steps, with a dissolvable resin;

(2) applying a coating resin containing an epoxy resin being solid at ordinary temperature;

(3) forming openings to be the ejection openings in the coating resin; and (4) dissolving the dissolvable resin layer.

That is, the nozzle formation member is formed of a hardened epoxy resin, and includes a wall member having walls for the liquid passages communicated with the ejection openings.

Through the steps described above, the liquid ejection head as shown in 8A can be obtained. The liquid ejection head of the present invention includes the substrate having a characteristic structure as shown in FIG. 4.

More precisely, the substrate of the present embodiment is formed such that plating of a metal (Ni) is applied on and the vicinity of the line portion 141. Here, the metal is an inorganic material having more OH groups than gold. Thereby, adhesion with the adhesion improvement layer 150, and in turn, with the nozzle formation member 203 can be improved. This prevents the nozzle formation member 203 from being separated from the substrate, and thus can improve the reliability of the liquid ejection head.

In addition, by properly applying the mask material 113 prior to the formation of the metallic layer (Ni layer) 112, Ni layer 112 is not formed on the electrode portion 140. This allows gold to be exposed on that portion after completion of the substrate, and thus makes it possible to reliably maintain the electric connection to the outside.

As a result, a highly-reliable substrate for liquid ejection head can be obtained through a proper lamination of the layers on the electric lines for supplying power to the ejection energy generating element being a metallic layer formed by plating.

Note that the layer disposed on the Au layer, which constitutes the line portion 141, to improve the adhesion with the organic resin can be made of any material as long as the layer can serve functions described above and has enough chemical stability against liquid such as ink when coming in contact therewith. In other words, the layer may be formed of Ni only, or may be formed of a material containing Ni as a main component.

The Ni layer used for the metallic layer 112 may be formed by sputtering, other than plating. The layer containing Ni as the main component means a Ni layer containing minute impurities incorporated when forming the metallic layer 112 by plating or sputtering.

In the structure described in the above example, the adhesion improvement layer made of organic resin serving also as an insulating layer is interposed between the substrate and the nozzle formation member. However, such an adhesion improvement layer does not necessarily have to be interposed when a good adhesion is achieved between the nozzle formation member made of an organic resin and the layer made of an inorganic material according to the present invention, and when, or to where, insulating properties do not need to be considered.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-159657, filed Jun. 18, 2008, which is hereby incorporated by reference herein in its entirety.

What is claimed is:

1. A method of manufacturing a liquid ejection head having an element which generates energy utilized for ejecting liquid and an electrode layer electrically connecting the element, the method comprising the steps of:

providing the electrode layer on a substrate, the electrode layer including a first portion and a second portion, a width of the second portion being less than that of the first portion when viewed from above, the second portion being connected with the first portion, providing a resist layer on at least a part of the first portion in such a manner that the resist layer contacts at least the part of the first portion and at least a part of the second portion and an end of the resist layer is positioned on the second portion;

providing another layer on another part of the electrode layer, excluding a portion on which the resist layer is provided, by utilizing the resist layer as a mask; and removing the resist layer.

2. A method as claimed in claim 1, wherein the electrode layer contains gold, and the another layer contains nickel.

3. A method as claimed in claim 2, wherein a resin layer is provided on the another layer.

4. A method as claimed in claim 3, wherein the resin layer comprises a member that forms a liquid passage.

5. A method as claimed in claim 1, wherein the electrode layer is substantially formed of gold, and the another layer is substantially formed of nickel.

6. A method as claimed in claim 1, wherein the another layer is formed by plating.

7. A method as claimed in claim 1, wherein the resist layer is provided by a screen printing method or a dispense method.

8. A method as claimed in claim 1, wherein the first portion is an electrode portion for electrical connection externally of the liquid ejection head.

9. A method as claimed in claim 1, wherein the electrode layer includes a third portion connected with the second portion and having a width that is greater than that of the second portion when viewed from above.

10. A method as claimed in claim 9, wherein the another layer is provided on the third portion.

* * * * *